US006000681A

United States Patent [19]

Hussaini

[11] Patent Number: 6,000,681

[45] Date of Patent: Dec. 14, 1999

[54] SADDLE STRUCTURE FOR AN EXTENDABLE JACK

[75] Inventor: Saied Hussaini, Miami, Fla.

[73] Assignee: Rally Manufacturing, Inc., Miami, Fla.

[21] Appl. No.: 08/904,343

[22] Filed: Jul. 31, 1997

[51] Int. Cl.[6] ..... B66F 3/38

[52] U.S. Cl. ..... 254/101; 254/133 R; 254/DIG. 4

[58] Field of Search ..... 254/8 B, 100, 254/101, 133, DIG. 4

[56] References Cited

U.S. PATENT DOCUMENTS 5,154,400 10/1992 Rotharmel ..... 254/243

FOREIGN PATENT DOCUMENTS 288419 4/1928 United Kingdom ..... 254/133

*Primary Examiner*—Timothy V. Eley
*Assistant Examiner*—Benjamin M. Halpern
*Attorney, Agent, or Firm*—Liniak, Berenato, Lonagacre & White

[57] ABSTRACT

A saddle structure for a jack device is provided with a rotatable saddle mounted to the fixed saddle of an extension member of a jack device. The rotatable saddle is retained, at least partially, within the fixed saddle for structural reinforcement. The Rotatable saddle provides an interface between the extension member of the jack device and the object to be lifted. The rotatable saddle is freely rotatable about a central axis of the extension member to allow the jack device to be independently oriented with respect to the object to be lifted. The fixed saddle structurally supports the rotatable saddle and is rigidly fixed to the extension member. Such an arrangement provides an adjustable interface between the jack device and the object to be lifted while maintaining the structural integrity of the interface.

5 Claims, 2 Drawing Sheets

SADDLE STRUCTURE FOR AN EXTENDABLE JACK

BACKGROUND OF THE INVENTION

1. Field of the Invention

This invention pertains to a jack device and more particularly to a structurally reinforced saddle structure for a conventional jack device.

2. Summary of the Prior Art

Numerous jack devices are well known in the art. Hydraulic, scissor, ratchet and pawl, screw, as well as other mechanical lifting devices have existed for a long time. In each of these devices, it is necessary to provide an interface between the jack device and the object to be lifted. Usually a planar or non-smooth substantially flat member is provided for this interface. However, in these prior art devices it is often necessary to rotate or turn the entire jack device to provide a good interface between the jack an object to be fitted. Such is particularly necessary when the interface is provided with longitudinal projections to prevent relative rotation between the object to be lifted and the jack by having the object disposed between these projections. In order to properly orient the object with the interface, the jack is necessarily rotated. This is undesirable, as larger floor type jacks are not always able to be fully rotated such as when poised underneath an automobile. Furthermore, while the properly positioned jack device may facilitate a good interface, it can cause the jack handle to be inconveniently located thus limiting range of motion.

Simply providing a known rotatable connection between the saddle and extension member may not be sufficient to alleviate the drawbacks of the prior art jack devices. Providing a conventional rotation connection will inherently induce substantial bending moments and stress concentrations about the rotation connection when even attempting to lift light loads.

Therefore, it is an object of the present invention not only to provide a conventional jack device with a rotatable saddle, but to maintain and/or strengthen the structural integrity as well.

SUMMARY OF THE INVENTION

A saddle structure for a jack device is provided with a rotatable saddle mounted to the fixed saddle of an extension member of a jack device. The rotatable saddle is retained, at least partially, within the fixed saddle for structural reinforcement. The Rotatable saddle provides an interface between the extension member of the jack device and the object to be lifted. The rotatable saddle is freely rotatable about a central axis of the extension member to allow the jack device to be independently oriented with respect to the object to be lifted. The fixed saddle structurally supports and reinforces the rotatable saddle and is rigidly fixed to the extension member. Such an arrangement provides an adjustable interface between the jack device and the object to be lifted while maintaining the structural integrity of the interface.

DETAILED DESCRIPTION OF THE PREFERRED EMBODIMENT

Figure 1:
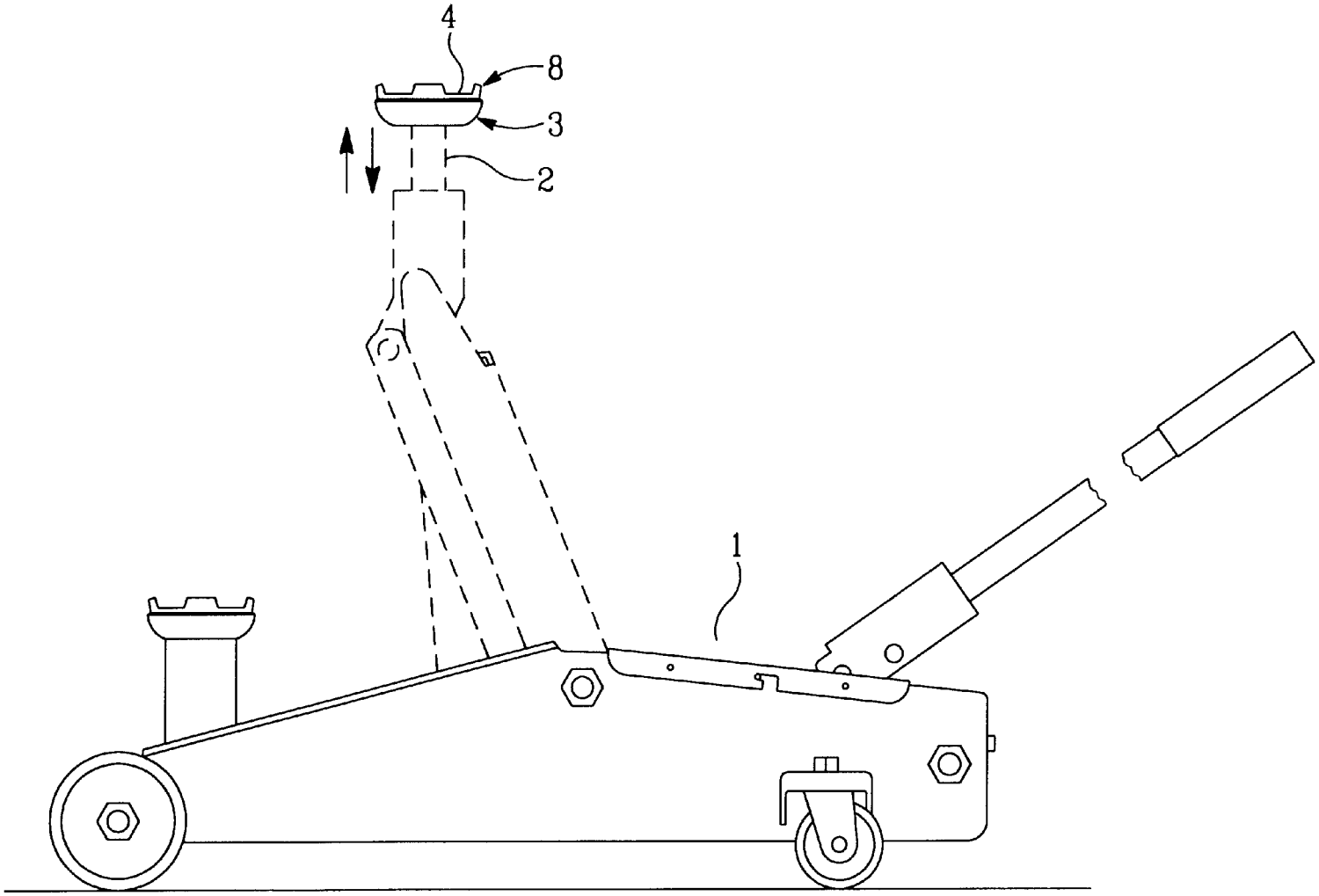
FIG. 1 is a side view of a conventional jack device with the saddle structure according to the invention.

FIG. 1 depicts a conventional jack device having an extension member 2 and a saddle structure 3, 4 according to the invention. This conventional floor jack device causes the extension member 2 to raise and lower thus providing the necessary force and extension to raise and lower an object as is known in the art. Other types of jack devices may also be used to raise and lower the extension member as is known in the art.

Figure 2C:
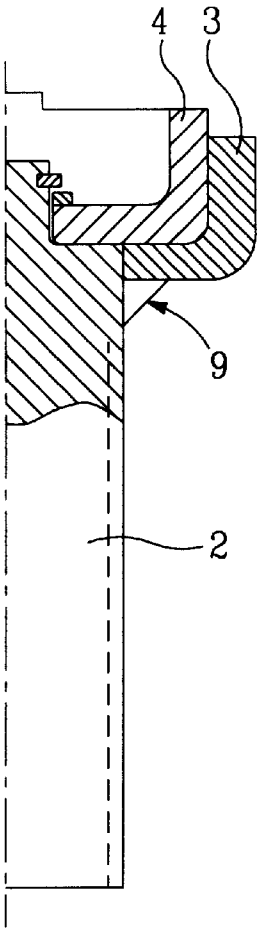
FIGS. 2B, and 2C are partial sectional views of saddle structures according to alternate embodiments of the invention.
Figure 2B:
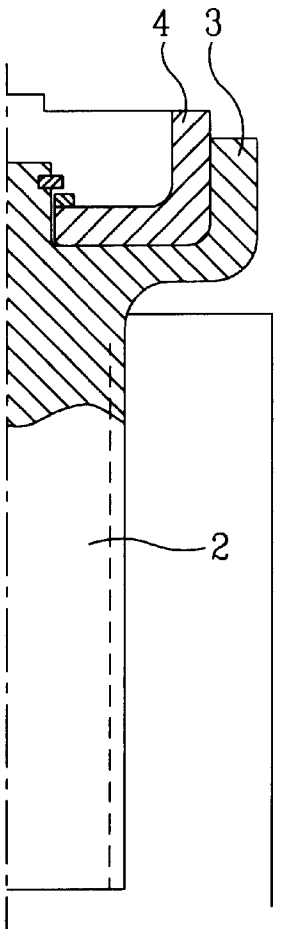
Figure 2A:
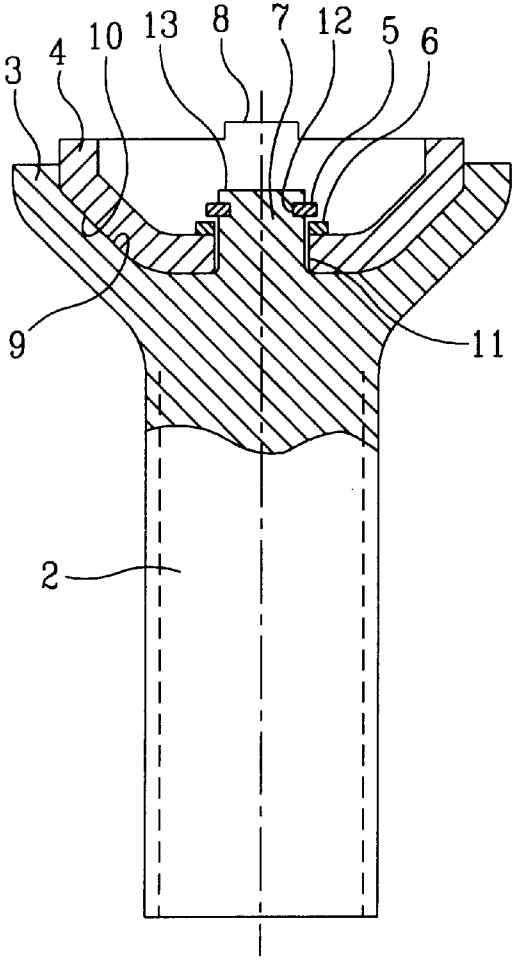
FIG. 2A is a sectional view of the saddle structure according to the preferred embodiment of the invention.

Referring now to FIG. 2A, the extension member 2 extends to a fixed saddle 3. Fixed saddle 3 extends longitudinally and radially outward from the extension member 2. The Fixed saddle 3 has an internal surface 9 to define a cavity to receive a rotatable saddle 4. Rotatable saddle 4 is rotatably disposed within the cavity and has an external surface corresponding to internal surface 9. Internal surface 9 and external surface 10 are correspondingly radially symmetrical to allow the rotatable saddle 4 to continuously rotate while providing structural support to the rotatable saddle 4 in any rotated position.

The rotatable saddle 4 is at least partially retained within the cavity in connection with the fixed saddle 3. A retaining extension 7 longitudinally extends from the extension member 2 through a bore 11 of the rotatable saddle 4 and terminates at a terminal end 13. An annular recess 12 is formed proximate the terminal end 13 of the retaining extension member 7. A retaining ring 5 is disposed within the annular recess 12 and a flat washer 6 is disposed between the retaining ring 5 and the rotatable saddle 4. The retaining ring 5 and the flat washer 6 together prevent longitudinal displacement of the rotatable saddle 4 while permitting relative rotation between the rotatable saddle 4, and the fixed saddle 3.

Reference number 8, represents diametrically opposed tabs for preventing an object from slipping off of the rotatable saddle 4 during operation of the jack device. These tabs 8 can also be used to prevent relative rotation between an object and the rotatable saddle device. Such tabs 8 provide for a more secure interface between the object and extension member 2.

It is an important aspect of the invention to provide structural support for the rotatable saddle 4 so that the rotatable support does not deform or break when subject to excessive loads. The instant invention has provided a novel and simple design to provide a rotatable saddle 4 which is strong and durable. In the preferred embodiment, as shown in FIG. 2A, the extension member and fixed saddle 3 are forged as one piece of steel or other strong material. The extension member, fixed saddle and rotatable saddle are also preferably heat treated to provide a hard surface. The fixed saddle 3 is also preferably internally threaded to provide extension adjustment. The rotatable saddle 4 nests within the fixed saddle 3 thereby being provided with the necessary structural reinforcement to withstand high loads over a prolonged period of time. The fixed saddle 3 is at least as wide as the rotatable saddle to eliminate any bending moments or sharp stress concentrations in the rotatable element 4. In preferred embodiment, as shown in FIG. 2A, the extension member 2 and fixed saddle is Y-shaped when viewed in cross section. This particular arrangement has been shown to provide excellent structural integrity while allowing free rotation of the rotatable saddle 4 and at the same time reducing sharp stress concentrations associated with perpendicular supports.

FIG. 2B depicts an alternative embodiment of the claimed invention quite similar to that of FIG. 2A. However, the fixed saddle 3 projects from the extension member 2 perpendicularly prior to extending longitudinally. Such an arrangement provides a normal seating surface between the direction of an applied load and the interface between the fixed 3 and rotatable 4 saddles.

In the preferred embodiment, the extension member 2, the fixed saddle 3 and the retaining extension 7 are homogeneously formed as a unitary body. However, as can be seen form FIG. 2C, the instant invention is not limited to such an arrangement. FIG. 2C depicts a fixed saddle 3 welded to the extension member 2. In this embodiment, the fixed saddle is in the form of a collar 3 disposed about the outer peripheral surface of the extension member 2. Weld 9 forms a permanent connection between the extension member 2 and the fixed saddle 3 to prevent longitudinal displacement as wells a relative rotation. Such an arrangement provides an alternative assembly of the saddle structure where forging the fixed saddle 3 may be prohibitive. Furthermore, the saddle structure of FIG. 2C provides the ability to assemble the saddle structure from stock materials which are readily available and need only be cut to desired specifications prior to assembly and welding.

While the foregoing invention has been shown and described with reference to a specific preferred embodiment, it will be understood by those possessing skill in the art that various changes and modifications may be made without departing from the spirit and scope of the invention.

I claim:

1. A saddle structure for a jack device for lifting and lowering an object, said saddle structure comprising:

a longitudinally extending extension member having a first end connected to said jack device and a second end formed as a fixed saddle;

a rotatable saddle freely rotatably mounted to said fixed saddle for rotation about a longitudinal axis of rotation, said rotatable saddle for engaging said object to be lifted thereby providing an interface between said object and said extension member, said rotatable saddle having a central bore centered about said axis of rotation; and a retaining means to retain said rotatable saddle in rotatable connection with said fixed saddle, said retaining means comprising a substantially cylindrical retaining extension defined by an integral and homogeneous portion of said extension member from an upper surface of said extension member along said longitudinal axis of rotation, said upper surface of said extension member supporting a portion of said rotatable saddle, said retaining extension extending through said central bore of said rotatable saddle;

said retaining means further comprising an annular recess proximate a terminal end of said retaining extension extending through said central bore of said rotatable saddle; a retaining ring disposed within said annular recess; and a flat washer disposed between said rotatable saddle and said retaining ring; wherein said flat washer and said retaining ring together preventing displacement of said rotatable saddle along said axis of rotation with respect to said extension member;

wherein said fixed saddle substantially structurally reinforces said rotatable saddle to enable said rotatable saddle to be subject to increased loads without failure.

2. A saddle structure according to claim 1, wherein said fixed saddle is formed as a flange longitudinally and radially outwardly extending from said extension member having a radially symmetrical internal surface defining a cavity, said rotatably saddle is at least partially disposed within said cavity and has an external surface substantially corresponding to and engaging said radially symmetrical internal surface to provide structural reinforcement.

3. A saddle structure according to claim 1, wherein said fixed saddle is homogeneously formed as a unitary body with said extension member such that said extension member and said fixed saddled when viewed in cross section is substantially Y-shaped.

4. A saddle structure according to claim 1, wherein said fixed saddle comprises an annular collar welded to an external peripheral surface of said extension member.

5. A saddle structure according to claim 1, wherein said fixed saddle has in internal surface defining a cavity which receives said rotatable saddle and said rotatable saddle has an external surface corresponding to said internal surface of said fixed saddle such that said internal surface and said external surface are correspondingly radially symmetrical, wherein at least a portion of said internal surface of said fixed saddle and of said external surface of said rotatable saddle correspondingly extend perpendicularly to said longitudinal axis of rotation.

* * * * *